US006484917B1

(12) United States Patent
Haber

(10) Patent No.: US 6,484,917 B1
(45) Date of Patent: Nov. 26, 2002

(54) BACKPACK ASSEMBLY FOR CARRYING ITEMS EXTERNALLY

(76) Inventor: Robert Haber, 1 Sherwood Dr., Larchmont, NY (US) 10538

( * ) Notice: Subject to any disclaimer, the term of this patent is extended or adjusted under 35 U.S.C. 154(b) by 0 days.

(21) Appl. No.: 09/929,966

(22) Filed: Aug. 15, 2001

(51) Int. Cl.[7] ..... A45F 3/04

(52) U.S. Cl. ..... 224/651; 224/153; 224/645; 224/650

(58) Field of Search ..... 224/651, 153, 224/650, 645, 627, 257, 901.2, 901.4, 901.6, 901.8, 915, 917

(56) References Cited

U.S. PATENT DOCUMENTS 42,895 A * 5/1864 Woods ..... 224/651
4,982,883 A * 1/1991 Ullal et al. ..... 224/643
5,400,937 A * 3/1995 Rottenberg ..... 224/257
5,577,652 A * 11/1996 Cooper ..... 224/153
5,950,894 A 9/1999 Haber
6,257,472 B1 * 7/2001 Freedman ..... 150/108

* cited by examiner

*Primary Examiner*—Stephen K. Cronin
*Assistant Examiner*—Maerena W. Brevard
(74) *Attorney, Agent, or Firm*—Gottlieb, Rackman & Reisman, P.C.

(57) ABSTRACT

An improved backpack assembly is provided. The backpack assembly includes a selectively accessible bag interior, and is defined by top, front, side, back and bottom panels, as is well known in the art. The backpack assembly also includes a pair of shoulder straps each having one end attached to the back panel of the bag at a location adjacent to the top panel, and a second end attached to the bag at a location adjacent to the bottom panel. A loop element is provided along each should strap for enabling said straps to be fixed in a doubled back folded over condition.

20 Claims, 4 Drawing Sheets

FIG.1
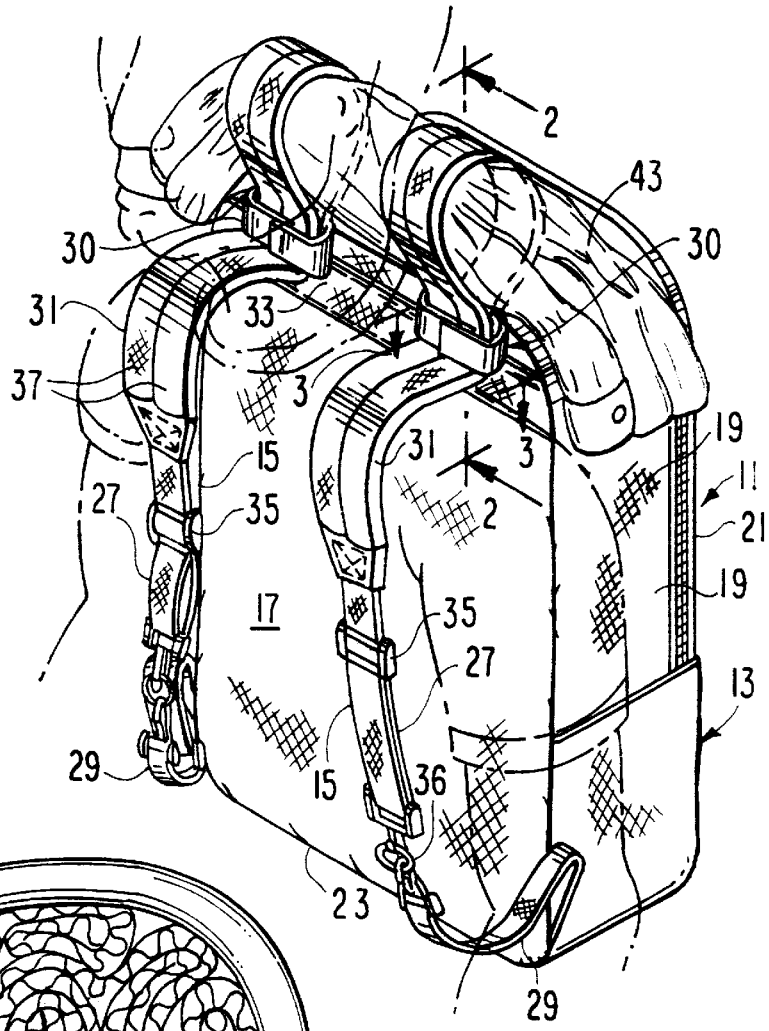
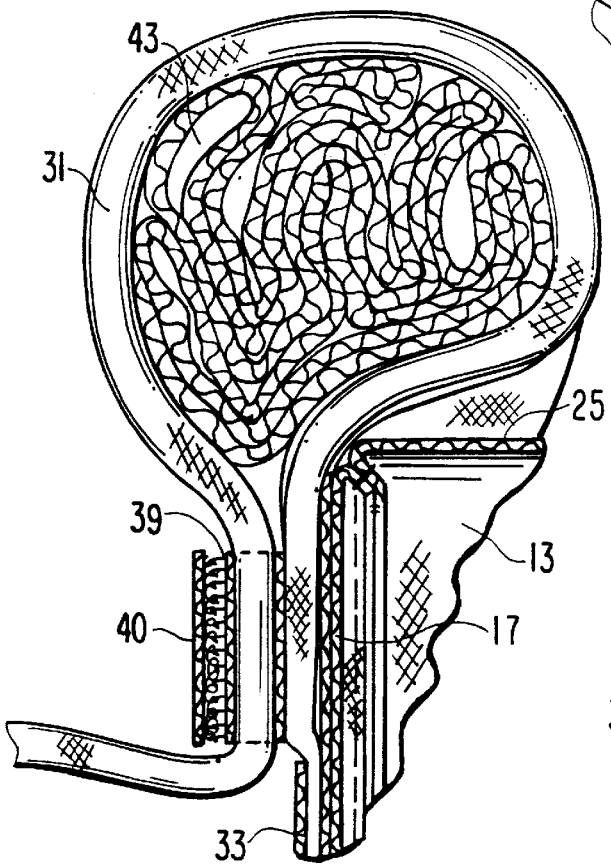
FIG.2
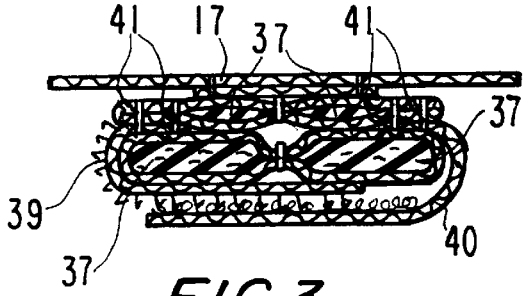
FIG.3

FIG. 4
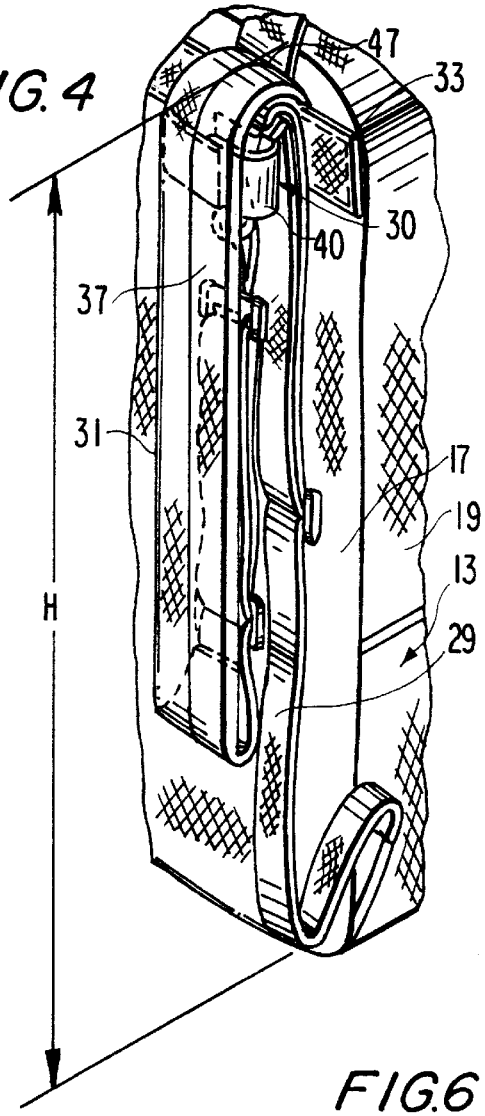
FIG. 5
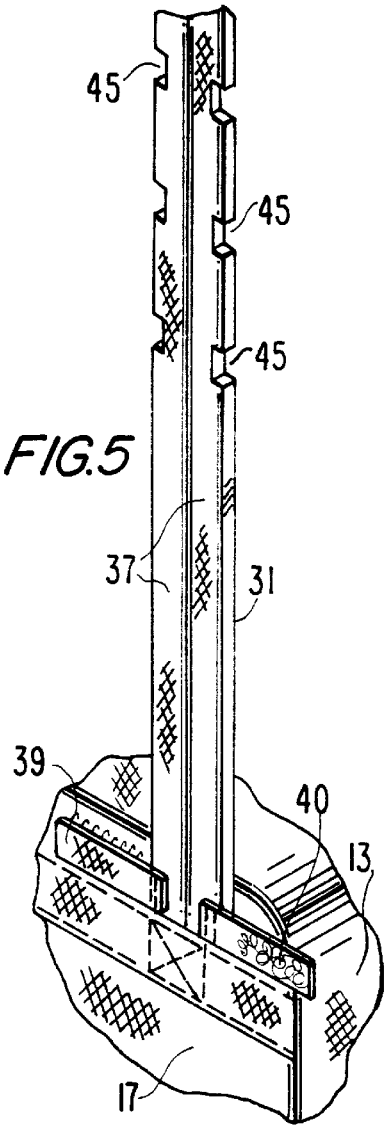
FIG. 6
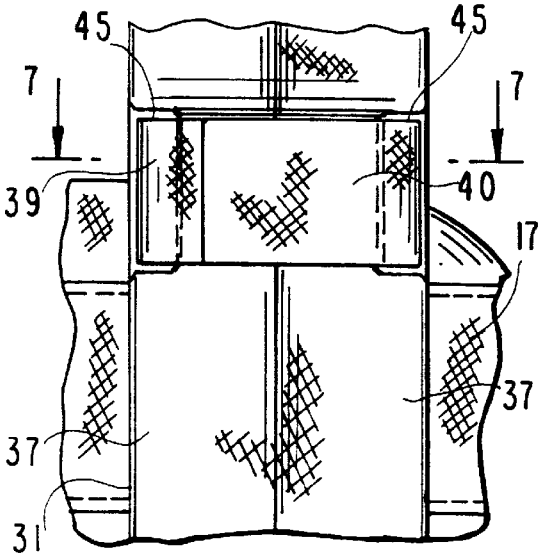
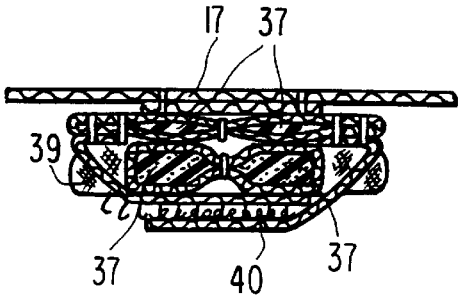
FIG. 7

FIG.8
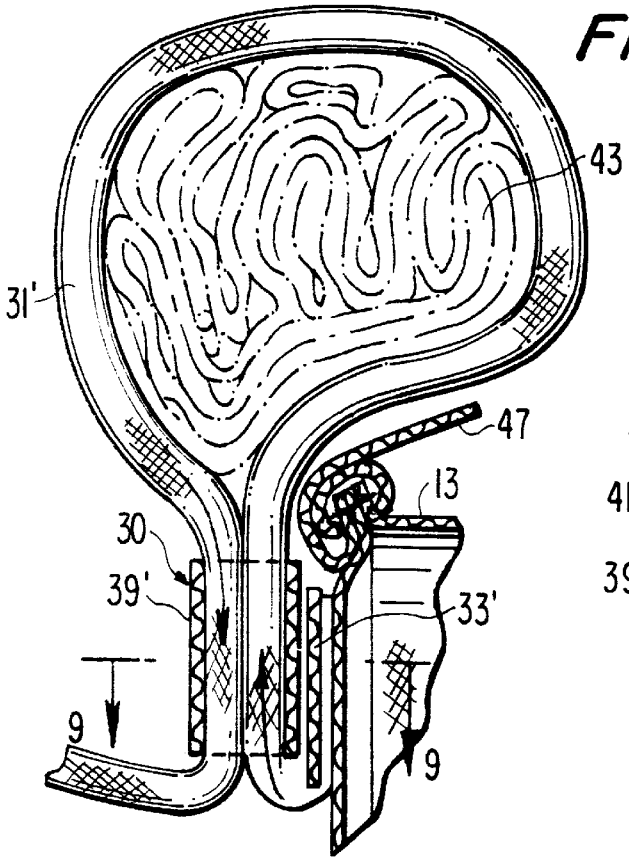
FIG.9
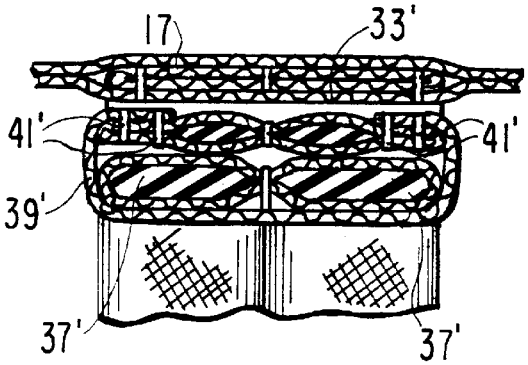
FIG.13
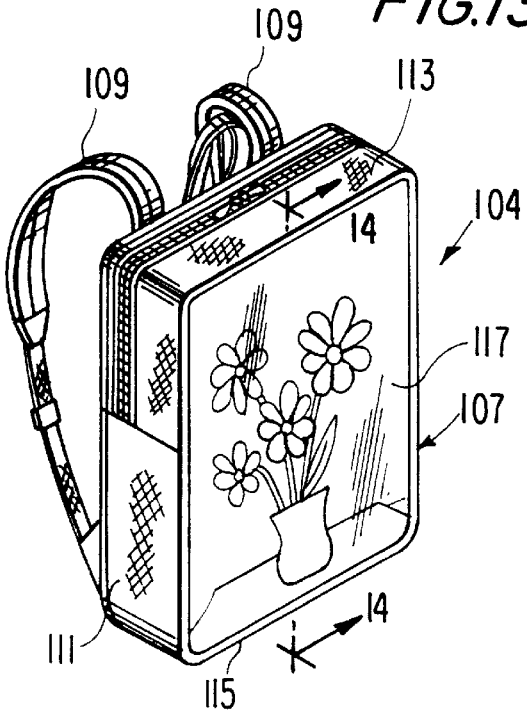
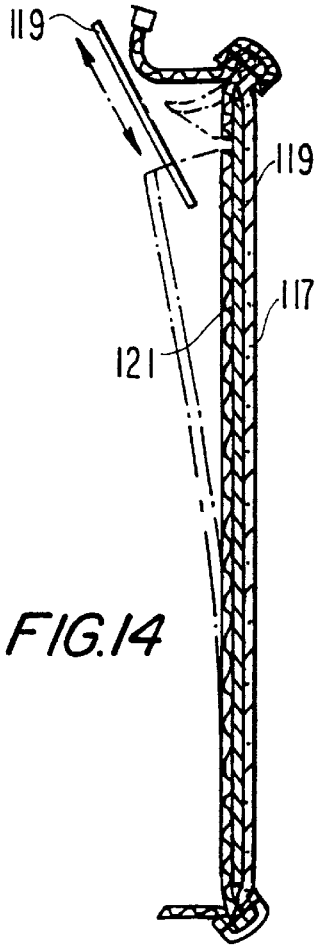
FIG.14

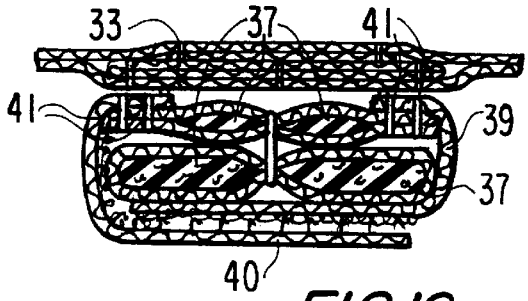
FIG.12
FIG.10
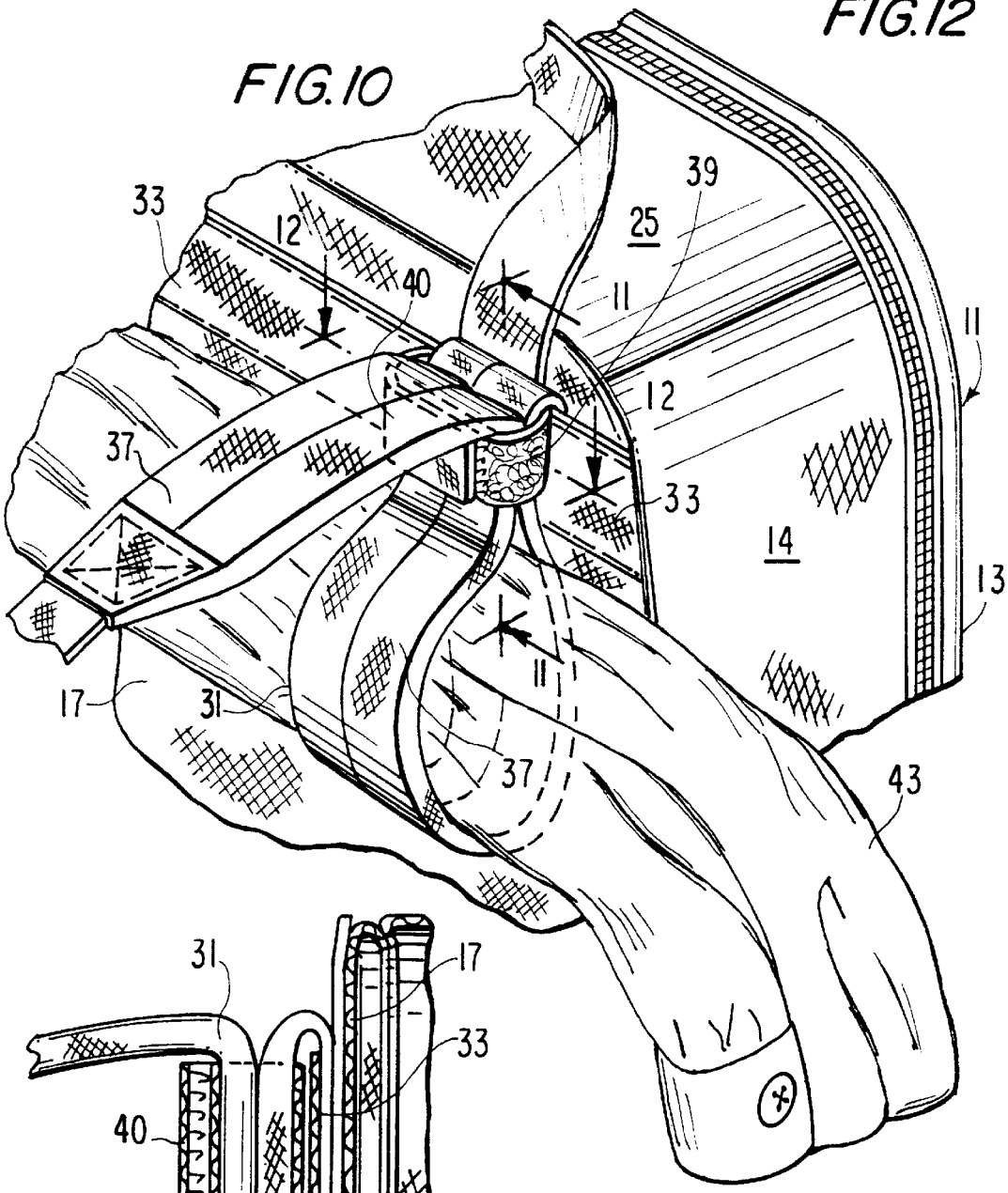
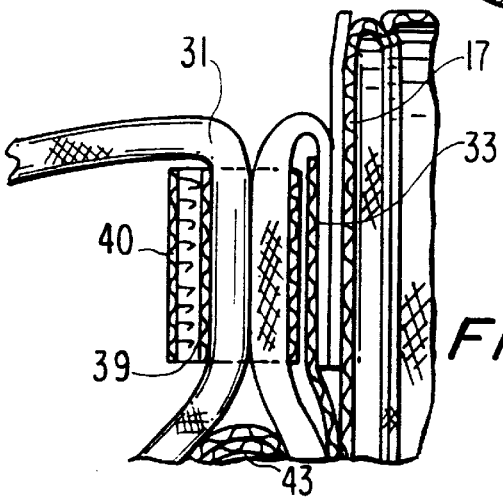
FIG.11

BACKPACK ASSEMBLY FOR CARRYING ITEMS EXTERNALLY

BACKGROUND OF THE INVENTION

This invention pertains to backpacks, and more particularly, to backpacks that are suitable for carrying a garment or other item along the outside thereof.

Backpacks are becoming more and more popular and are used by students, people in the workplace, and by individuals in general for carrying items in a convenient manner.

One problem with conventional backpack assemblies is their limited capacity for storing items. For example, for students, a backpack may be large enough to hold school supplies and books, but may be insufficient in size to also accommodate the student's jacket or sweater. As a consequence, the student ends up carrying the jacket or sweater in their hands.

Accordingly, it would be desirable to overcome this disadvantage and create a backpack assembly which can not only retain items inside the bag unit, but also retain items on the outside.

SUMMARY OF THE INVENTION

Generally speaking, in accordance with the invention, an improved backpack assembly is provided. The backpack assembly includes a selectively accessible bag, and is defined by top, front, side, back and bottom panels, as is well known in the art. The backpack assembly also includes a pair of shoulder straps each having one end attached to the back panel of the bag at a location adjacent to the top panel, and a second end attached to the bag at a location adjacent to the bottom panel.

Significantly, there is provided a loop-type element attached to each shoulder strap at a first location therealong and adjacent to where one end of each shoulder strap is attached to the back panel. The loop element is designed for selectively capturing therewithin a portion of the shoulder strap at a second location therealong when the strap is folded over or doubled back on itself. In this folded over condition, a garment, such as a jacket or sweater or other item, may be captured within the shoulder straps and stored along the outside of the backpack assembly.

Accordingly, it is an object of the invention to provide an improved backpack assembly.

Another object of the invention is to provide a backpack assembly for retaining a garment or other item along the outside of the backpack.

Still other objects and advantages of the invention will in part be obvious, and will in part be apparent from the following description.

BRIEF DESCRIPTION OF THE DRAWINGS

For a fuller understanding of the invention, reference is made to the following description taken in connection with the accompanying drawings, in which:

FIG. 1 is a perspective view of the backpack assembly of the invention in which a garment is carried by the shoulder straps at a location along the top panel of the bag;

FIG. 2 is a cross-sectional view taken along line 2—2 of FIG. 1;

FIG. 3 is a cross-sectional view taken along line 3—3 of FIG. 1;

FIG. 4 is a perspective view of the backpack assembly of the invention, in which the shoulder straps are folded over and inwardly for storage during carrying;

FIG. 5 is a perspective view illustrating a modified version of a shoulder strap of the inventive backpack assembly;

FIG. 6 is a front elevational view showing the modified shoulder strap illustrated in FIG. 5 in a folded over condition; FIG. 7 is a cross-sectional view taken along line 7—7 of FIG. 6;

FIG. 8 is a side view in cross section similar to FIG. 2 and illustrating a different form of the loop element;

FIG. 9 is a cross-sectional view taken along line 9—9 of FIG. 8;

FIG. 10 is a partial perspective view of the backpack assembly of the invention in which a garment is carried by the shoulder straps along the upper portion of the front panel;

FIG. 11 is a cross-sectional view taken along line 11—11 of FIG. 10;

FIG. 12 is a cross-sectional view taken along line 12—12 of FIG. 10;

FIG. 13 is a perspective view of the inventive backpack assembly having a replaceable rear panel insert; and FIG. 14 is a cross-sectional view taken along line 14—14 of FIG. 13.

DETAILED DESCRIPTION OF THE PREFERRED EMBODIMENTS

Referring first to FIGS. 1—3, a backpack assembly made in accordance with the invention and generally indicated at 11 is described. Backpack assembly 11 comprises a bag generally indicated at 13 and a pair of strap assemblies generally indicated at 15. Bag 13 is formed with a front panel 17, side panels 19, a rear panel 21, a bottom panel 23 and a top panel 25, which together define a bag interior.

As shown in FIG. 1, each strap assembly 15 of backpack assembly 11 comprises an upper shoulder strap 27 and a lower shoulder strap 29 to which the upper strap 27 is selectively coupled by means of a hook connection 36. Each upper strap 27 includes a cushioned portion 31 made of a padded fabric material and divided into integrated cushioned strap members 37. Each upper strap 27 is sewn at one end to the top edge of a reinforcing horizontally extending fabric panel 33 located on front panel 17 along the top portion thereof. As is shown, the lower end of each upper strap 27 includes a buckle assembly 35 for selectively adjusting the length of strap 27 as is well known. Each lower shoulder strap 29 has an end that is attached to the lower portion of front panel 17.

Significantly,cushioned portion 31 of each upper shoulder strap 27 has a loop element generally defined at 30 attached thereto at a location adjacent to where strap 27 is sewn to fabric panel 33. Each loop element 30 is defined by loop members 39 and 40, as best illustrated in FIG. 3. The ends of loop members 39 and 40 are sewn to corresponding integrated strap members 37 of cushioned portion 31 by means of stitching 41 (see FIG. 3). One surface of loop member 39 is formed with a plurality of hook elements while the corresponding surface of loop member 40 is formed with a series of loop elements for selective mating engagement with the hook elements. Cushioned portion 31 of each of straps 27 is capable of double backing or folding over on itself. Each of loop members 39 and 40 of each loop element 30 then selectively attaches to one another by means of the hook and loop fastening elements in order to maintain this folded over condition of each cushioned portion 31.

As can be appreciated from viewing FIGS. 1–3, a garment 43 can be carried along top panel 25 of bag 13 of backpack assembly 11. Garment 43 is disposed within folded over cushioned portions 31 of straps 27. In particular, garment 43 is placed against cushioned portion 31 of straps 27 and then straps 27 are wrapped or tied about garment 43, as shown in FIG. 2. Then, loop members 39 and 40 of loop elements 31 are either tightened or maintained loose. Loosely tying loop members 39 and 40 of loop elements 30 causes straps 27 to tightly grip garment 43 once the backpack assembly is mounted on the wearer. This maintains the security of the garment, but nonetheless could wrinkle, crease or otherwise damage the garment. Therefore, tying loop members 39 and 40 tightly may be carried out instead, resulting in straps 27 staying fixed in position relative to loop elements 30 regardless of the tension exerted when assembly 11 is worn.

In accordance with the invention, other objects may be carried along the outside of the inventive backpack assembly. Depending on the items being carried, either an adjustable or fixed hold may be used, again depending on how tightly loop members 39 and 40 of each loop element 30 are tightened around cushioned portions 31 of straps 27.

Turning now to FIG. 4, backpack assembly 11 is shown in use when hand carried, in order to prevent straps 27 from dangling therebeneath. In order to prevent this problem, which is not only unsightly, but can be dangerous, lower shoulder straps 29 are secured by means of the loop elements 30. This is achieved by lifting straps 27 and 29, when connected, upwardly, and then placing the loop elements around the strap 29 when disposed in a folded condition underneath cushioned portion 31 of upper strap 27 (see FIG. 4).

Turning now to FIGS. 5–7, cushioned portion 31 of each upper strap 27 is shown modified to include a series of indents 45 disposed along corresponding locations of strap members 37. Indents 45 enable loop members 39 and 40 of loop element 30 to firmly engage cushioned portion 31 at selected desired locations therealong, thereby forming a more secure coupling.

Referring now to FIGS. 8–9, a slightly modified embodiment of the inventive assembly is illustrated. In this embodiment, bag 13 includes an upwardly extending handle 47 for carrying backpack assembly 11 by hand (also found in the embodiment of FIG. 4). Bag 13 also includes a horizontally extending fabric panel 33' having a lower edge from which cushioned portion 31' of upper shoulder strap depends. Moreover, a loop element 30' comprises a single continuous loop member 31' stitched to cushioned portion 31' by means of stitching 41' (see FIG. 9). In this embodiment, the user or wearer of the backpack assembly of the invention is precluded from selecting the size of loop 30'. Instead, the inventive backpack assembly is predesigned with a certain size loop 30'.

In FIGS. 10–13, backpack assembly 11, as depicted in FIGS. 1–3 discussed hereinbefore, is shown in a slightly different fashion. As shown, garment 43 is placed instead along the side of the upper portion of front panel 17 of bag 13 and cushioned portion 31 of each of straps 27 is doubled back and wrapped about garment 43. The, as before, loop members 39 and 40 of each loop element 30 are tied around cushioned portion 31—this tying may be done either loosely or tightly, depending on whether it is desirable or not to have straps 27 tightened about garment 43 when assembly 11 is carried or worn. Moreover, whether or not a garment is to be carried, the length of straps 27 may be adjusted (shortened) in order to selectively carry assembly 11 higher along the wearer's back.

Referring now to FIGS. 13 and 14, an alternative version of the inventive backpack assembly is illustrated, this time generally indicated at 104. Assembly 104 comprises a bag generally indicated at 107 and a pair of strap assemblies 109. Bag 107 is formed with a front panel (not shown), side panels 111, top panel 113, bottom panel 115 and back panel 117, which together define a bag interior.

As shown in FIG. 14, back panel 117 is designed for receiving a visual display insert 119. Back panel or cover 117, made of a clear plastic material, and a flexible pocket panel member or wall 121, which may have an image imprinted thereon, together define a pocket for selectively receiving display insert 119 as desired. This enables the backpack wearer the opportunity to express his or her individuality. Display insert 119 may include a visual scene, a personality, a reproduction of a well known work of art, or some other visual presentation that is desired. Multiple inserts 119 may be provided, each having a different image. Any one insert may be selected or replaced with another as desired. Alternatively, no insert may be used and therefore the image printed on panel member 121 would be visible. Importantly, panel 117, which is made of a clear plastic, should include some type of UV filtering properties in order to reduce the effect of the sun's rays.

Although the various embodiments are shown with respect to a backpack assembly, the inventive system is equally applicable to other bags such as a handbag.

It will thus been seen that the objects set forth above, and those made apparent from the preceding description, are efficiently attained, and since certain changes may be made in the products set forth above without departing from the spirit and scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A backpack or other bag assembly comprising:

a bag defining a bag interior and comprising a top, front, bottom and rear panels;

at least one strap having a first end fixedly attached to the front panel at a location adjacent to the top panel, and a second end fixedly attached to the bag at a location adjacent to the bottom panel;

a loop element attached to said at least one strap at a first location therealong and adjacent to where said first end is attached to said front panel;

said loop element designed for selectively securing said at least one strap at a second location therealong distant from where said first end is attached to said front panel and when said strap is in a doubled back folded over condition.

2. The assembly of claim 1, wherein said loop element comprises a first loop member and a second loop member selectively connectible to said loop member.

3. The assembly of claim 2, wherein said first loop member includes a plurality of hook elements and said second loop member includes a plurality of corresponding loop elements for selective engagement with said hook elements.

4. The assembly of claim 3, wherein said first and second loop members are adjustably tightenable about said strap at said second location.

5. The assembly of claim 1, wherein said strap includes a cushioned portion running at least partly along said strap.

6. The assembly of claim 5, wherein said at least one strap includes an upper shoulder strap member and a lower shoulder strap member selectively connectible to said upper shoulder strap member.

7. The assembly of claim 6, wherein said cushioned portion runs at least partly along said upper shoulder strap member.

8. The assembly of claim 7, wherein said cushioned portion runs between said first and second locations.

9. The assembly of claim 8, wherein said second location defines a series of indents formed in said cushioned portion for selectively receiving said tying loop element.

10. The assembly of claim 5, wherein said cushioned portion comprises a plurality of integrated cushioned strap members.

11. The assembly of claim 1, wherein said at least one strap includes an upper shoulder strap member and a lower shoulder strap member selectively connectible to said upper shoulder strap member.

12. The assembly of claim 11, wherein at least one of said upper and lower strap members includes a buckle assembly for selectively adjusting the length of said at least one strap.

13. The assembly of claim 11, wherein said upper strap is selectively connectible to said lower strap by means of a hook connection.

14. The assembly of claim 1, wherein said first end of said at least one strap is connected to said first panel along a reinforcing panel member.

15. The assembly of claim 1, wherein said at least one strap comprises a pair of shoulder straps.

16. A backpack or other bag assembly comprising:

a bag defining a bag interior and comprising a top, front, bottom and rear panels;

at least one strap having a first end fixedly attached to the front panel at a location adjacent to the top panel, and a second end fixedly attached to the bag at a location adjacent to the bottom panel;

wherein said at least one strap includes at least one coupling member depending from a first location therealong and adjacent to where said first end is attached to the front panel;

wherein said coupling member, when said strap is in a doubled back folded over condition, is selectively attachable to said at least one strap at a second location therealong distant from where said first end is attached to said front panel.

17. The assembly of claim 16, wherein said strap includes a cushioned portion running at least partly along said strap.

18. The assembly of claim 17, wherein said cushioned portion runs between said first and second locations.

19. The assembly of claim 16, wherein said at least one strap includes an upper shoulder strap member and a lower shoulder strap member selectively connectible to said upper shoulder strap member.

20. The assembly of claim 16, wherein said at least one strap includes a series of indents at said second location for facilitating attachment of said coupling member to said strap.

* * * * *